US005845393A

United States Patent [19]

DePaiva

[11] Patent Number: 5,845,393

[45] **Date of Patent: *Dec. 8, 1998**

[54] CONNECTOR ASSEMBLY TOOL

[75] Inventor: Dwayne A. DePaiva, Ocoee, Fla.

[73] Assignee: Daniels Manufacturing Corporation, Orlando, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 761,224

[22] Filed: Dec. 6, 1996

[51] Int. Cl.[6] ..... H01R 43/042

[52] U.S. Cl. ..... 29/751; 29/268; 29/758; 29/828; 29/861; 72/409.14; 72/712

[58] Field of Search ..... 29/751, 753, 755, 29/758, 828, 861, 863, 33 M, 268; 72/409.06, 409.14, 409.19, 7.2

[56] References Cited

U.S. PATENT DOCUMENTS

| | | | |
|---|---|---|---|
| 2,369,180 | 2/1945 | Rosenthal | 29/751 X |
| 2,786,095 | 3/1957 | Arbeiter | 29/828 X |
| 3,325,885 | 6/1967 | Ziegler, Jr. et al. | 29/751 |
| 3,711,942 | 1/1973 | Reynolds | 29/753 X |
| 4,730,385 | 3/1988 | Ryan et al. | 29/857 X |
| 5,211,049 | 5/1993 | Lucas | 29/751 |
| 5,392,508 | 2/1995 | Holliday et al. | 72/409.19 X |
| 5,546,653 | 8/1996 | Tournier et al. | 29/751 |
| 5,647,119 | 7/1997 | Bourbeau et al. | 29/753 X |

FOREIGN PATENT DOCUMENTS

| | | | |
|---|---|---|---|
| 47-21865 | 6/1972 | Japan | 29/828 |
| 132914 | 11/1978 | U.S.S.R. | 29/751 |

*Primary Examiner*—Peter Vo

*Attorney, Agent, or Firm*—James H. Beusse; Maguire, Voorhis & Wells

[57] ABSTRACT

A crimping tool is provided for attaching a connector to a shielded coaxial cable. One connector on which the tool can be employed is an improved BNC type connector including a sliding center pin which is movable into the interior of the connector, such connector also including a crimpable ferrule for holding the cable to the connector. The crimping tool includes a pair of opposed crimping dies for crimping the ferrule to hold the connector to the cable. A lower crimping die of the tool includes a fitted receptacle for receiving the connector. A pair of handles are coupled to the opposed crimping dies to drive the dies together to crimp the ferrule. The crimping tool further includes a driving member for pushing the center pin of the connector into the interior of the connector simultaneously with the closure of the crimping dies to crimp the ferrule onto the shielded cable.

5 Claims, 5 Drawing Sheets

CONNECTOR ASSEMBLY TOOL

BACKGROUND OF THE INVENTION

This invention relates in general to crimping tools and, more particularly, to crimping tools for use with BNC-type connectors and similar connectors.

BNC connectors are often used to connect coaxial cable to various electrical devices and apparatus. Coaxial cable is typified by a center conductor surrounded by an insulative dielectric which is surrounded by a conductive shield. The conductive shield is often braided to furnish the cable with flexibility. Typically, the conductive shield is covered by a protective insulative sheath. All of these elements are coaxially situated with respect to the center conductor.

As shown in FIG. 1A, a typical BNC connector 10 includes a main connector body 12 having a twist lock end 15 with a center pin (not shown) and a back end 20 for receiving a prepared coaxial cable. As seen in FIG. 1B, one end of a coaxial cable 25 is prepared for installation in the BNC connector by stripping a portion of the outer insulative sheath 30 away to expose the conductive shield 35 thereunder. A portion of the exposed shield 35 and a smaller portion of the insulative dielectric 37 are stripped away to provide an exposed center connector 40. The exposed center conductor 40 is connected to a center pin (not shown) of the connector. Returning to FIG. 1A, connector 10 also includes a ferrule 45 which is slid over the prepared end of coaxial cable 25 as shown in FIG. 1C.

The back end 20 of main connector body 12 is slid under the exposed shield 35 as shown in FIG. 1D so that back end 20 locates itself between dielectric 37 (not visible in this view) and exposed shield 35. Ferrule 45 is now advanced from the position shown in FIG. 1D and slid toward main connector body 12 such that at least a portion of ferrule 45 is situated over exposed shield 35. Ferrule 45 is then crimped onto the overlapping shield 35 on back end 20, as shown in FIG. 1E, using a conventional crimp tool. In this arrangement, the center conductor 40 may be used as a male pin conductor for connection to a female connector (not shown). In more conventional Mil Spec BNC connectors, either a male pin or female pin is crimped or soldered onto conductor 40 before insertion into the connector housing.

A relatively new development in connector design is the Model QT BNC type connector manufactured by ITT Corporation. In this improved BNC connector, the male or female pin that is connected to conductor 40 is integrally manufactured in the connector 10. The pin is coupled to a sliding mechanism which drives a ferrule within the connector in an axial direction causing the ferrule to compress a split end of the pin onto a conductor 40 inserted into the connector. This new BNC connector thus does not require any crimping or soldering of the center pin onto the conductor 40. After insertion of the cable end into the connector in order to couple the conductor to the pin, i.e., the integral pin must be driven into the connector in order to effect the conductor to pin connection. Thus, a new crimping tool is needed for connecting a coaxial cable to the improved BNC connector.

SUMMARY OF THE INVENTION

Accordingly, one object of the present invention is to provide an assembly tool for connecting a coaxial cable to the improved BNC connector.

Another object of the present invention is to provide an assembly tool which provides both crimping of the connector ferrule and movement of the sliding member of the connector into the interior of the connector.

In accordance with one embodiment of the present invention, an assembly tool for attaching a connector to a shielded cable is provided. One connector on which the tool is used is an improved BNC-type connector which includes a center pin situated in a sliding member and a ferrule for holding the cable to the connector. The assembly tool includes a pair of opposed crimping jaws for crimping the ferrule to hold the connector to the cable. The assembly tool incorporates a die for receiving the connector within the pair of opposed crimping jaws. The assembly tool also includes a pair of handles, coupled to the pair of opposed crimping jaws, for causing the pair of jaws to be driven together to crimp the ferrule. The tool further includes a driving member for pushing the center pin of the connector into the interior of the connector simultaneously with the pair of opposed crimping jaws being driven together to crimp the ferrule.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings.

DETAILED DESCRIPTION OF THE INVENTION

An assembly tool has been invented which both crimps the ferrule of the improved Model QT BNC type connector and pushes the center pin of the connector and an associated plastic slide into the interior of the connector so that the inner workings of the connector clamp onto the center wire of a coaxial cable. For convenience, the disclosed tool is often referenced herein as a crimping tool although it is capable of functions in addition to the crimping function.

Figure 2:
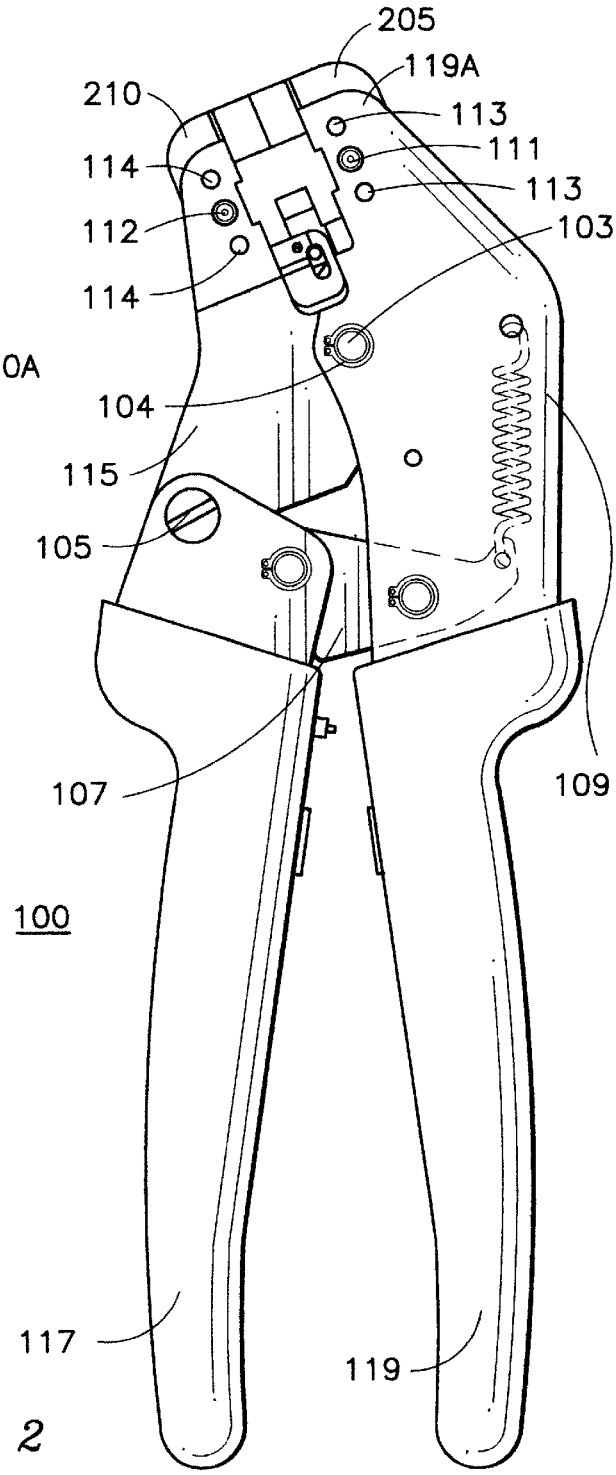
FIG. 2 is a side view of a connector assembly tool in accordance with the present invention.

More particularly, the new tool is shown in FIG. 2 as crimping tool 100. The handle portion of tool 100 is adapted from other conventional crimping tools such as the Model DCT4-106 tool available from Daniels Manufacturing Corp. of Orlando, Fla. The Model DCT4-106 is a side-entry crimping tool for crimping the ferrule 45 on prior types of BNC or similar connectors. The tool 100 employs a handle arrangement of a type often used in a locking plier. A pair of opposed hand-actuated handle members 117 and 119 are connected to drive a moveable jaw 115 toward an end 119A of handle 119. Jaw 115 pivots about a pin 103 passing through jaw 115 and handle 119. Pin 103 is straight and grooved on both ends to receive lock rings 104 which hold the pin in its operative position. The pin 103 acts as a pivot point for jaw 115. The handle 119 extends to the top of the tool 100 where end 119A is adapted for receiving a stationary die 205 which is attached to the handle by a screw 111 and optional pins 113. A mating die 210 is fixed to jaw 115 by a screw 112 and optional pins 114. When the handle member 117 is squeezed toward handle member 119, jaw 115 pivots about pinned connections 103 in handle member 119 and 105 in handle member 117. An intermediate member 107 pivotably connects handle members 119 and 117 and forces jaw 115 to pivot toward handle member end 119A as member 117 closes toward member 119. A spring 109 pulls member 107 causing it to pivot about pin 103 as handle member 117 is opened so that moveable jaw member 115 is retracted to its normal open position when handle member 117 is released or moved to its open position.

Figure 1A:
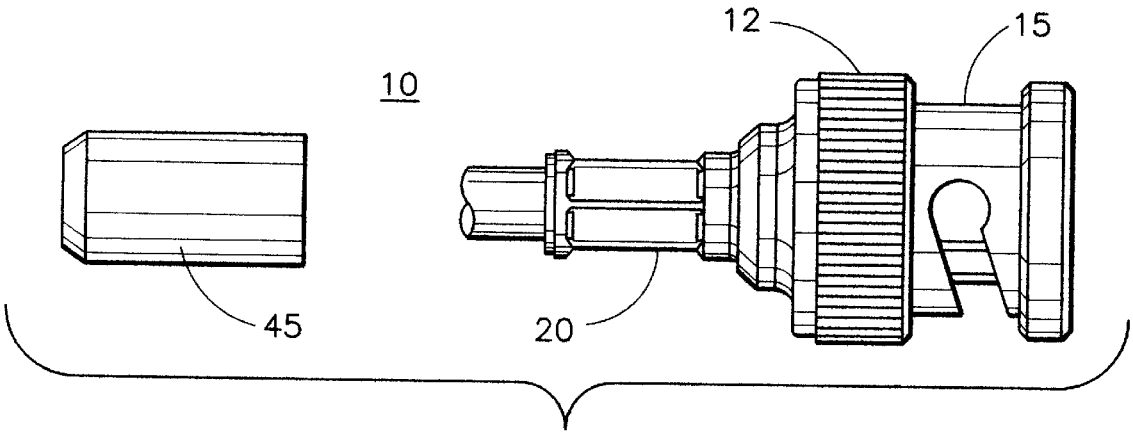
FIG. 1A (PRIOR ART)
FIG. 1A is a plan view of a conventional BNC type connector.
Figure 1B:
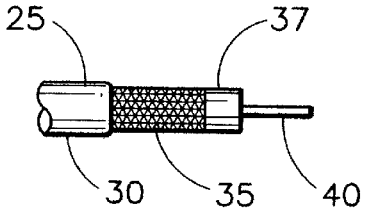
FIG. 1B (PRIOR ART)
FIG. 1B is a plan view of a coaxial cable appropriately stripped and dressed for insertion into the conventional BNC type connector of FIG. 1A.
Figure 1C:
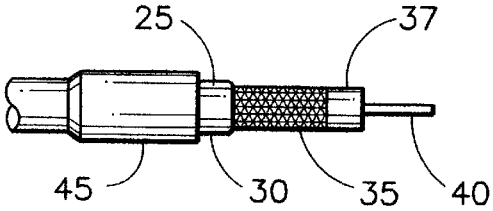
FIG. 1C (PRIOR ART)
FIG. 1C is a plan view of the coaxial cable of FIG. 1B with the ferrule of the conventional BNC connector of FIG. 1A installed thereon.
Figure 1D:
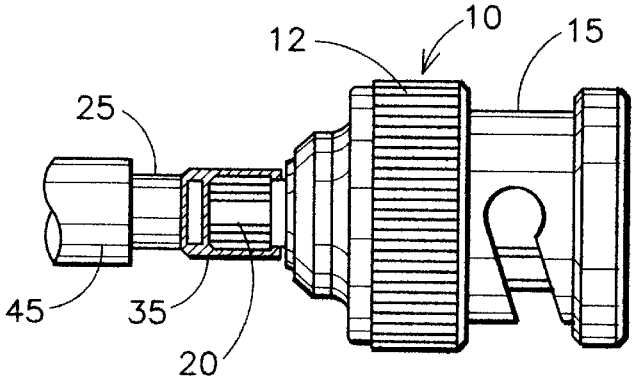
FIG. 1D (PRIOR ART)
FIG. 1D is a plan view the coaxial cable of FIG. 1C installed on the conventional BNC connector of FIG. 1A.
Figure 1E:
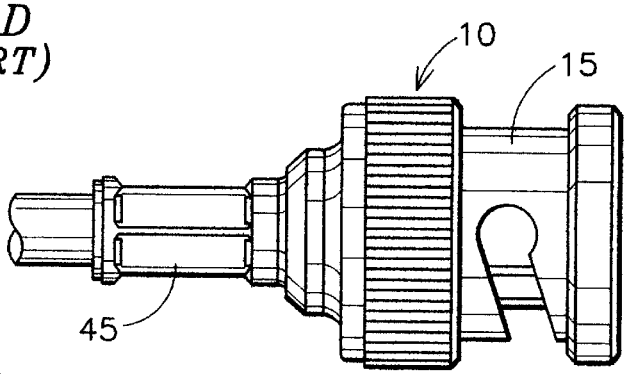
FIG. 1E (PRIOR ART)
FIG. 1E is a plan view of the crimped connection of the ferrule onto the overlapping shield.

Referring now to FIGS. 3A–3E, there are shown partial cross-sectional views of the crimping end 200 of tool 100 and, more specifically, the jaw dies 205 and 210 which connect to the handle end 119A and moveable jaw 115, respectively. For simplicity and ease of understanding of the invention, the handle portion of the tool 100 is omitted in all but FIG. 2. FIGS. 3A–3E are sequential drawings showing the position and operation of the dies 205 and 210 during each step of crimping an improved BNC connector 215 onto a coaxial cable such as the cable shown in FIG. 1B.

Figure 4:
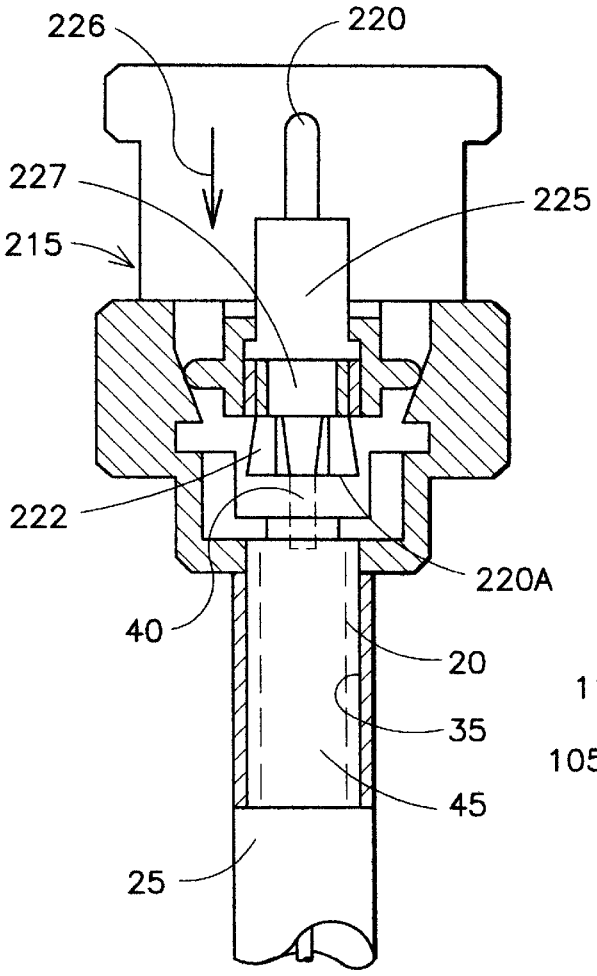
FIG. 4 is a cross-sectional view of an improved BNC connector with which the present assembly tool may be used.

Before describing the invention as shown in FIGS. 3A–3E, reference is first made to FIG. 4 which is a simplified cross-sectional view of the improved BNC connector 215 with which the present invention is to be used. Externally, the BNC connector 215 appears identical to prior connector 10 and similar components are shown with identical reference numbers. Accordingly, only the internal components will be described. Connector 215 includes an integral, fixed center pin 220 having an internal end 220A which is enlarged and axially slotted to form a plurality of fingers 222. Normally, the fingers 222 are spread as shown so that when cable 25 is inserted into connector 215, the center conductor 40 will easily slip into the enlarged pin end 220A. The pin 220 is electrically connected to conductor 40 by pushing plastic slide 225 in the direction indicated by arrow 226. Slide 225 pushes lock ring 227 over fingers 222 causing the fingers to compress onto conductor 40. The ferrule 45 is then crimped onto braided shield 35 over hollow shell back end 20 completing the attachment of connector 215 to cable 25. As will be described, applicant's inventive tool uses a single operation to both attach conductor 40 to pin 220 and crimp ferrule 45 on the conductor back end 20.

Figure 3A:
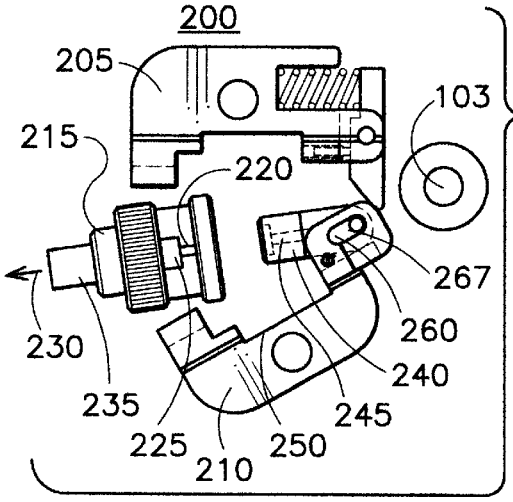
FIG. 3A is a plan view of the disclosed assembly tool dies before the connector is fully positioned therein.
Figure 3B:
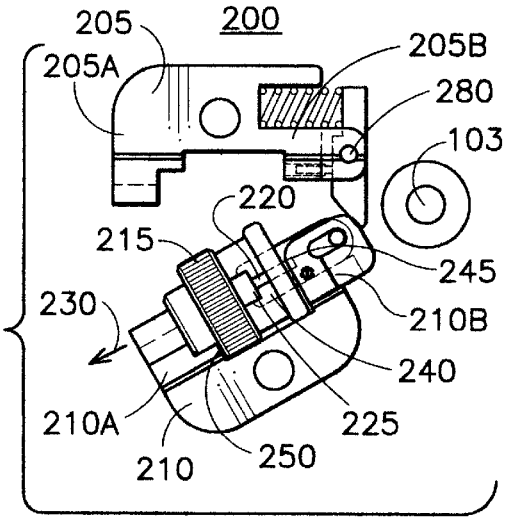
FIG. 3B is a plan view of the disclosed assembly tool dies after the connector is seated in the die of the tool.
Figure 3C:
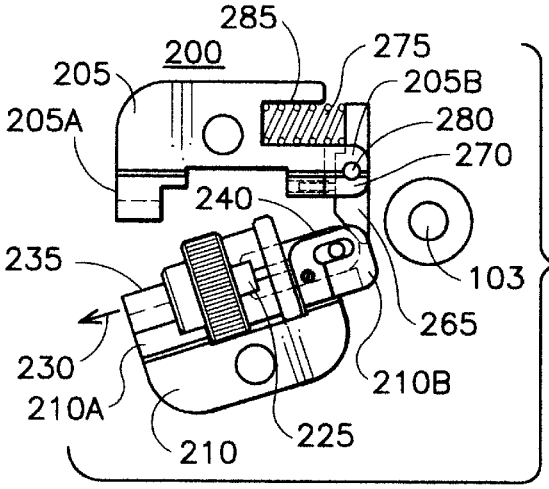
FIG. 3C is a plan view of the disclosed assembly tool dies shown as the jaws of the tool start to close on the connector.
Figure 3D:
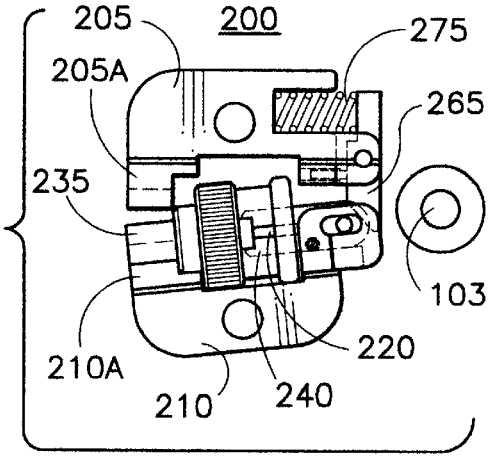
FIG. 3D is a plan view of the disclosed assembly tool dies shown as the sliding member of the connector is caused to slide into the interior of the connector and as the tool starts to crimp the ferrule.
Figure 3E:
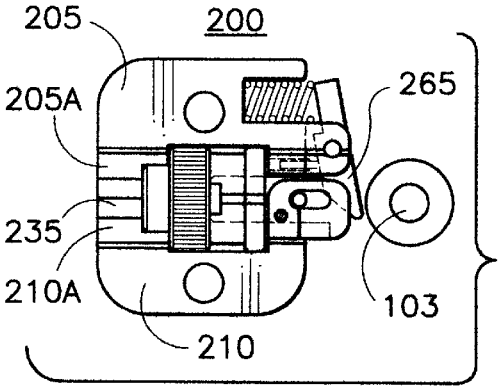
FIG. 3E is a plan view of the disclosed assembly tool dies shown when the sliding member of the connector is fully driven into the interior of the connector and after the ferrule is fully crimped.

As illustrated in FIGS.3A–3E, the improved BNC connector 215 includes the center pin 220 which passes through sliding member 225 along a central major axis 230 of connector 215. The ferrule 45 is shown in its assembled position over the back end 20 of connector 215 but the coaxial cable 25 is omitted for clarity. FIG. 3A shows dies 205 and 210 as they would be positioned in crimping tool end 200 with handle members 117 and 119 in the open position ready for loading connector 215 into the tool. A push rod or center member 240 is pivotably and slidably connected to a rearward end of lower die 210. Center member 240 includes an opening 245 shaped to receive the center pin 220 of connector 215 therein. FIG. 3B shows how connector 215 is rotated down into a loaded position after being inserted into push rod 240. FIG. 3C shows how member 240 fits over pin 220 and pushes on sliding member 225, typically a plastic slide, in the axial direction indicated by axis arrow 230 as dies 205 and 210 rotate toward each other. FIGS. 3D and 3E illustrate final closing steps of the dies 205, 210. In FIG. 3D, the plastic slide member 225 is fully depressed and spring loaded lever 265 has been rotated slightly counterclockwise. In FIG. 3E, the dies are fully closed and ferrule 235 is crimped.

Figure 5A:
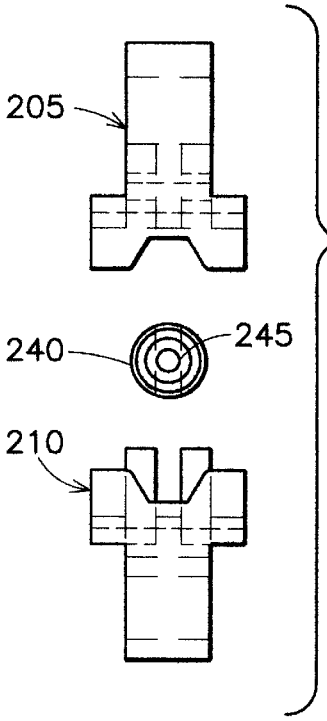
FIG. 5A is a left side view of the disclosed assembly tool dies.
Figure 5B:
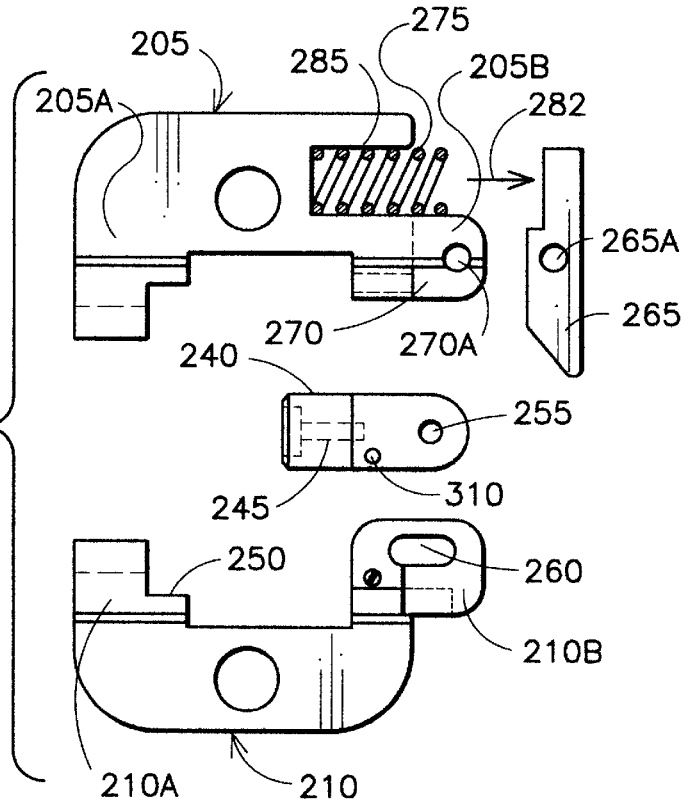
FIG. 5B is a front plan view of the disclosed assembly tool dies.
Figure 5C:
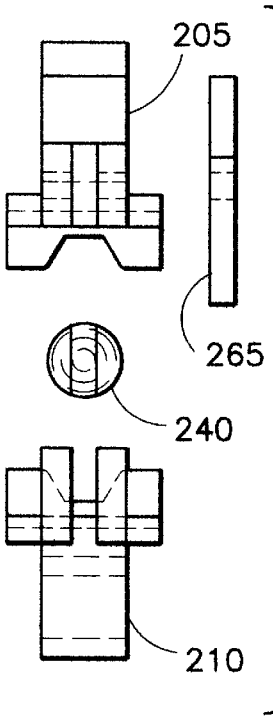
FIG. 5C is a right side view of the disclosed assembly tool dies.

Referring briefly to FIGS. 5A–5C, the dies 205, 210 of crimping tool end 200 are exploded into their various components. For example, FIG. 5A is an exploded front end view of upper die 205, lower die 210 and center member 240 as they would appear looking into the jaw opening. The opening 245 for receiving the center pin 220 of the improved BNC connector can be seen in the visible end of member 240. FIG. 5B is an exploded side view of the components of tool end 200. FIG. 5C is an exploded rear end view of upper die 205, lower die 210, center member 240 and pivot member 265.

Returning to FIG. 3B, crimping tool end 200 is shown with improved BNC connector 215 fully loaded therein and ready for crimping. Connector 215 is positioned in a fitted opening 250 in lower die 210. Center pin 220 of connector 215 engages and fits into opening 245 of center member 240. Center member 240 is pivotally and slidably attached to the lower die 210 at end 210B which allows the connector 215 to be seated in the opening 250 without exerting an axial force onto pin 220 or slide 225. Upper die 205 includes opposed ends 205A and 205B. Lower die 210 includes opposed ends 210A and 210B.

The nature of the pivotal, slidable attachment of center member 240 to lower die 210 is more readily appreciated from an examination of FIG. 5B. The rearward end of center member 240 includes an opening 255. The rearward end 210B of lower die 210 includes an elongated opening 260. In an assembled position as shown in FIG. 3B, the opening 255 overlaps opening 260 and a pin 267 fits through the two openings to pivotably and slidably attach member 240 to lower die 210. The degree of sliding movement of member 240 is determined by the elongate dimension of opening 260. The degree of movement need only be sufficient to fully depress slide 225 and seat ring 17 about fingers 14 of connector 215 when connector 215 is seated in opening 250.

In FIG. 3B, it is seen that improved connector 215 is seated in opening 250 and that crimping has not yet commenced. Center member 240 is now in contact with sliding member 225 although center member 240 has not yet started to be urged toward connector 215 in the direction of axis arrow 230. However, as illustrated in FIG. 3C, when the user of the tool begins to squeeze the handle portion of the tool together, multiple actions occur as now described. Lower jaw 115 holding lower die 210 pivots about pin 103 and closes toward upper jaw end 119A holding upper die 205. Movement of lower die end 210B brings a rear end 240A of member 240 in contact with an angled edge 265B of spring loaded lever 265. At the same time, lower die end 210A starts to approach upper die end 205A at the frontward portion of the tool in preparation for crimping ferrule 235 in position.

Figure 6:
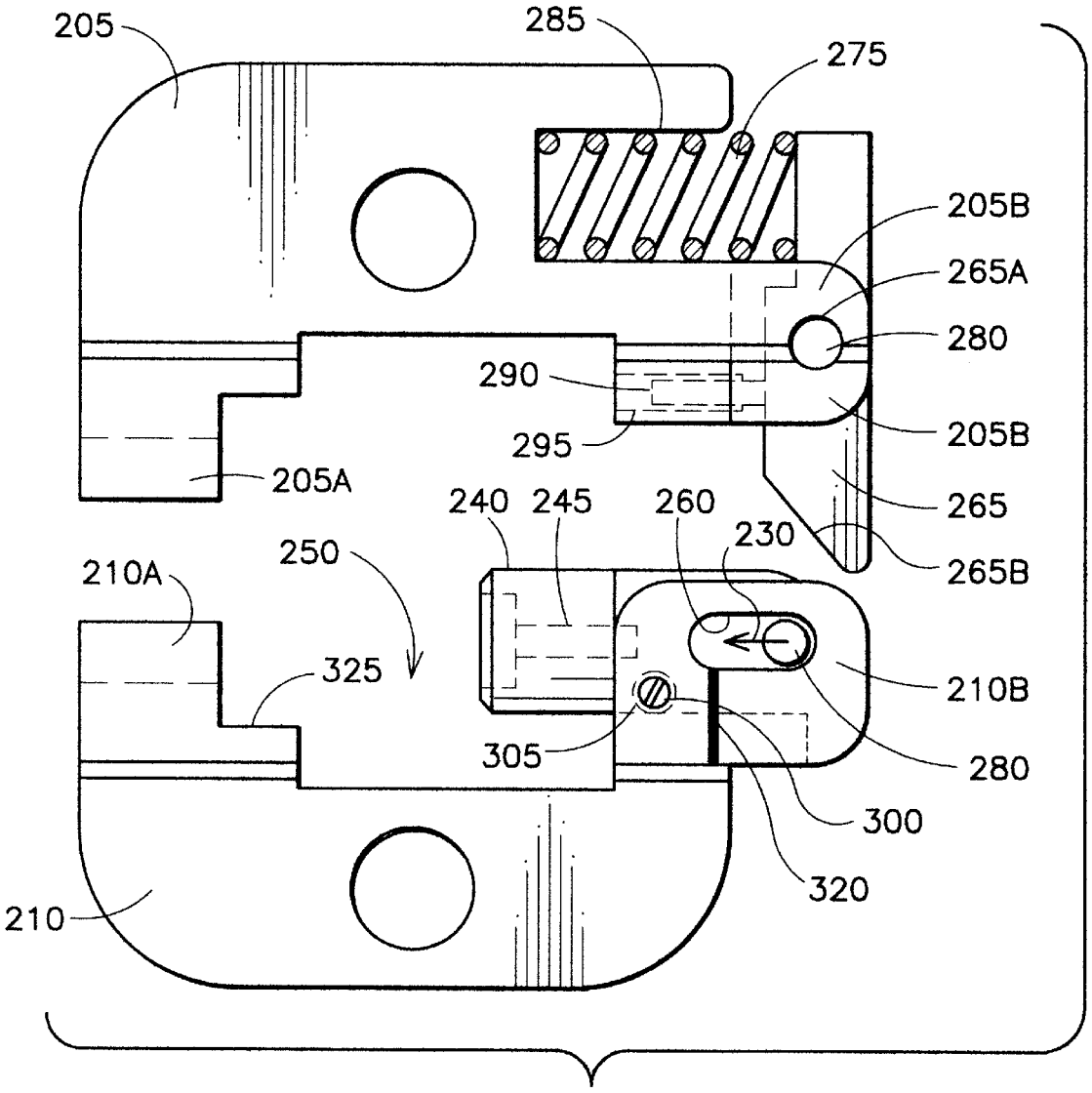
FIG. 6 is a more detailed front plan view of the disclosed assembly tool dies.

Spring loaded lever 265 is centrally attached to an extension 270 of upper die end 205B as shown in FIG. 3C. Referring briefly to FIGS. 5B and 6 in conjunction with FIG. 3C, lever 265 includes a generally central opening 265A which aligns with an opening 270A in extension 270 such that a pin 280 can be positioned through both openings 270A and 265A to pivotally attach lever 265 to extension 270. A bias spring 275 urges lever 265 in a clockwise direction. Bias spring 275 is situated in a bias spring well 285 located in upper die end 205B at the rearward portion of the tool adjacent extension 270 as illustrated.

As the operator of the tool continues to squeeze the handles together, upper die 205 and lower die 210 are brought closer together as shown in FIG. 3D. In so doing, bias spring 275 compresses allowing lever 265 to pivot in a counter-clockwise direction. The spring constant of spring 275 is selected to provide sufficient force to seat lock ring 227 but to allow lever 265 to be driven counter-clockwise as the jaws continue to close and force connector 215 toward lever 265 due to the position of pivot pin 103. Without pivoting of lever 265, connector 215 could be damaged due to overtravel of center member 240.

Continued squeezing of the handles 117, 119 together brings upper die end 205A and lower die end 210A into compression position about ferrule 235 as shown in FIG. 3E. In this final stage in the operation of tool 100, upper die end 205A may actually meet and contact lower die end 210A when ferrule 235 is properly crimped about cable 25. To reiterate the operation of the tool, as the tool user squeezes the tool handles together, spring loaded lever 265 drives center member 240 and sliding member 225 into the interior of the connector. Spring 275 is needed since center member 240 will bottom out as it moves into the connector and lever 265 needs to release. The tool handles are subsequently opened by the return spring 109 and the crimped cable/connector assembly is removed from the tool.

FIG. 6 depicts an expanded side view of the dies 205 and 210 of crimping tool 100 with the connector 215 omitted. FIG. 6 shows the same components of the die portion of crimping tool 100 as FIGS. 3A–3E except in larger scale and in greater detail. In FIG. 6, it can be seen that there is provided a set screw 290 in a threaded aperture 295 in upper jaw end 295B. The set screw 290 is adjusted to set the initial position of lever 265 so as to position lever cam end 265B adjacent member 240 and to eliminate "backlash" when the tool is opened. Further, there is provided a ball plunger 300 in an aperture 305 in lower jaw end 210B adjacent member 240. Ball plunger 300 acts as a detent in cooperation with recess 310 in member 240 (see FIG. 5B) to establish an aligned position of member 240. A visual reference to determine when the ring 227 is fully seated in connector 215 is provided by alignment of pin 280 on member 240 and line 320 on jaw end 210B. To assure seating when the lines 280 and 320 align, the size of seat opening 250 and shelf 325 are precisely machined to fit with connector 215 whose dimensions are set to meet commercial and military specifications.

The foregoing has described an assembly tool for connecting a coaxial cable to an improved BNC connector. Advantageously, the disclosed assembly tool provides two desirable functions, namely, movement of the sliding member/center pin of the connector into the interior of the connector and crimping of the connector ferrule.

While only certain preferred features of the invention have been shown by way of illustration, many modifications and changes will occur to those skilled in the art. It is, therefore, to be understood that the present claims are intended to cover all such modifications and changes which fall within the true spirit of the invention.

What is claimed is:

1. An assembly tool for attaching a BNC type connector to a shielded cable of the type having a center conductor within a dielectric insulator, a conductive shield encompassing the center conductor and an outer insulative sheath overlaying the shield, the connector including a connector body and a rear annular sleeve extending therefrom, the sleeve being adapted for internally receiving the conductor and dielectric insulator, and for externally receiving the shield and sheath, a ferrule slidably positionable over the shield and sheath overlaying the annular sleeve, which ferrule can be crimped for holding the cable to the connector, and a center pin fixed within the connector body and connectable to the center conductor of the cable within the body of the connector by pressing a lock ring within the connector body laterally with respect to a direction of crimping of the ferrule, the assembly tool comprising:

a pair of opposed crimping dies for crimping the ferrule to hold the connector to the cable;

a seat within the tool for receiving the connector body and positioning the annular sleeve and ferrule within the pair of opposed crimping dies;

a pair of handles, coupled to the pair of opposed crimping dies, for causing the pair of dies to be driven together to crimp the ferrule onto the shield and sheath over the annular sleeve; and a driving member operatively connected to at least one of the handles and positioned to exert a lateral force for driving the lock ring within the interior of the connector body into crimping engagement with the center conductor concurrently with the pair of opposed crimping dies being driven together to crimp the ferrule.

2. An assembly tool for attaching a connector to a shielded cable, the connector including a ferrule for holding the cable to the connector and an integral center pin connectable to the cable conductor by pressing a lock ring within the connector laterally with respect to a direction of crimping of the ferrule, the assembly tool comprising:

an upper crimping die;

a lower crimping die opposed to the upper crimping die;

a pair of handles, coupled to the upper and lower crimping dies, for causing the upper and lower crimping dies to be driven together to crimp the ferrule;

a seat in the lower crimping die for receiving the connector;

a center member pivotally and slidably attached to the lower crimping die for receiving the center pin of the connector therein; and a lever pivotally attached to the upper crimping die to engage the center member of the tool as the upper and lower crimping dies are driven together upon closure of the pair of handles of the tool, the pivoting member urging the lock ring of the connector into the interior of the connector concurrently with the upper and lower crimping dies being driven together to crimp the ferrule onto the shielded cable.

3. The assembly tool claim 2 wherein the upper crimping die includes a spring well with a bias spring situated in the spring well for spring loading the pivoting member.

4. An assembly tool for attaching a connector to a shielded cable, the connector including a ferrule for holding the cable to the connector and an integral center pin connectable to the cable conductor by pressing a lock ring within the connector laterally with respect to a direction of crimping of the ferrule, the assembly tool comprising:

an upper crimping die including opposed front and rear ends;

a lower crimping die opposed to the upper crimping die, the lower crimping die including opposed front and rear ends;

a pair of handles, coupled to the upper and lower crimping dies, for causing the upper and lower crimping dies to be driven together to crimp the ferrule;

a seat in the lower crimping die for receiving the connector;

a center member pivotally and slidably attached to the rear end of the lower crimping die for fitting into a pin end of the connector; and a lever pivotally attached to the rear end of the upper crimping die to engage the center member of the tool as the upper and lower crimping dies are driven together upon closure of the pair of handles of the tool, the lever urging the center member into the interior of the connector to press the lock ring into a seated position concurrently with the upper and lower crimping dies being driven together to crimp the ferrule onto the shielded cable.

5. The assembly tool of claim 4 wherein the rear end of the upper crimping die includes a spring well with a bias spring situated in the spring well for spring loading the lever.

* * * * *